US006953370B2

(12) United States Patent
Matsuoka et al.

(10) Patent No.: US 6,953,370 B2
(45) Date of Patent: Oct. 11, 2005

(54) CONNECTOR

(75) Inventors: Hiroyuki Matsuoka, Yokkaichi (JP); Michiaki Okamoto, Yokkaichi (JP); Atsushi Nishida, Toyota (JP); Hiroyuki Nakanishi, Toyota (JP); Masato Minakata, Toyota (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/873,795

(22) Filed: Jun. 22, 2004

(65) Prior Publication Data

US 2004/0266271 A1 Dec. 30, 2004

(30) Foreign Application Priority Data

Jun. 23, 2003 (JP) ..... 2003-178338

(51) Int. Cl.[7] ..... H01R 13/64
(52) U.S. Cl. ..... 439/680; 439/489
(58) Field of Search ..... 439/680–681, 439/488–489, 79, 752, 595, 352, 544, 157, 557, 549, 372, 374–378

(56) References Cited

U.S. PATENT DOCUMENTS 5,791,935 A * 8/1998 Yamanashi ..... 439/489
6,089,909 A * 7/2000 Tokuwa ..... 439/557
6,332,789 B1 * 12/2001 Okabe ..... 439/157
6,478,632 B2 * 11/2002 Tanaka ..... 439/752
6,638,099 B2 * 10/2003 Nakamura ..... 439/489
6,733,343 B2 * 5/2004 Morita et al. ..... 439/680
6,767,239 B2 * 7/2004 Fukamachi ..... 439/378
6,783,388 B2 * 8/2004 Matsushita ..... 439/489
2003/0017748 A1 1/2003 Morita et al.

* cited by examiner

*Primary Examiner*—Gary Paumen
*Assistant Examiner*—Edwin A. Leon
(74) *Attorney, Agent, or Firm*—Gerald E. Hespos; Anthony J. Casella

(57) ABSTRACT

An attempt to fit an improper combination of housings (10, 30) together brings a projection (32R) of the wrong housing (30) into abutting engagement with an interference portion (15) in a fitting recess (12). Abutment surfaces (15*a*, 32Ra) are inclined in directions to move an inner peripheral surface of the fitting recess (12) towards an outer peripheral surface of the wrong housing (30). Therefore, the fitting recess (12) cannot deform and spread out, and the fitting of the wrong housing (30) cannot proceed by force.

7 Claims, 7 Drawing Sheets

CONNECTOR

BACKGROUND OF THE INVENTION

1. Field of the Invention

This invention relates to a connector with an erroneous-fitting detection function.

2. Description of the Related Art

A typical connector has a male housing that can be inserted into a fitting recess in a female housing. Different kinds of male housings often have identical outer shapes and different kinds of female housings often have fitting recesses with substantially identically configured inner peripheries. However, the different kinds of housings may differ from one another with respect to the number of poles, and there is a fear that an improper combination of female and male housings will be fit together.

U.S. Patent Application Publication No. U.S. 2003/0017748 A1 discloses connectors with projections formed on the outer periphery of each male housing so that the positions of the projections are different for different kinds of male housings. Grooves are formed in the inner periphery of the fitting recess of each female housing at positions for receiving the projections of the corresponding male housing. Thus, a proper combination of the female and male housings can be fit together without hindrance. However, the projections interfere with an opening edge of the fitting recess when the housings form an improper combination so that the fitting operation is prevented.

Housings generally are made of a synthetic resin, and therefore the opening edge of the fitting recess can be deform and spread outwardly. Such a deformation can be caused by the ribs on the male housing when the wrong male housing is mistakenly urged into the fitting recess of the female housing.

This invention has been made in view of the above circumstances, and an object of the invention is to enable erroneous fitting to be detected positively.

SUMMARY OF THE INVENTION

The invention relates to a connector comprising a female housing that has a fitting recess, and a male housing for fitting into the fitting recess. A projection is formed on one of an outer periphery of the male housing and an inner periphery of the fitting recess, and a groove is formed in the other. The projection can fit in the groove when the female and male housings form a proper combination and are properly disposed relative to each other, thereby allowing the housings to fit together. However, the projection interferes with the mating housing to limit the fitting of the two housings when the female and male housings form an improper combination, or are improperly disposed relative to each other. An interference portion is formed on the housing having the groove, and the projection abuts against the interference portion when the two housings form an improper combination, or are improperly disposed relative to each other. An abutment surface of the interference portion and an abutment surface of the projection are oblique relative to a direction of fitting of the housings, and are inclined in a direction so that the inner periphery of the fitting recess and the outer periphery of the male housing are moved toward each other when a fitting force acts on the abutment surfaces. Therefore, the fitting recess cannot be deform and spread outwardly and the fitting cannot proceed.

The projection would engage the interference portion before the fitting is started if the projection and the interference portion were formed respectively at the front faces of the two housings. Therefore, there is a fear that the operator would fail to become aware of an improper combination or an improper disposition. Rather, the operator may mistakenly assume that the two housings are misaligned, and may try to continue the fitting operation.

To avoid the above-described problem, an escape recess preferably is formed in the inner periphery of the fitting recess or the outer periphery of the male housing for receiving the projection, and the interference portion preferably is formed at an inner end of the escape recess. Thus, the abutment surfaces abut against each other when the male housing is fit a predetermined amount into the fitting recess. Accordingly, the fitting operation is limited when the fitting proceeds by the predetermined stroke, and the improper combination or the improper disposition can be detected positively.

The above-described problem also may be avoided by recessing abutment surface of the projection rearwardly from a front face of the housing that has the projection. Thus, the abutment surfaces abut against each other when the male housing is fit a predetermined amount into the fitting recess. Accordingly, the fitting operation is limited when the fitting proceeds by the predetermined stroke, and the improper combination or the improper disposition can be detected positively.

DETAILED DESCRIPTION OF THE PREFERRED EMBODIMENTS

Figure 1:
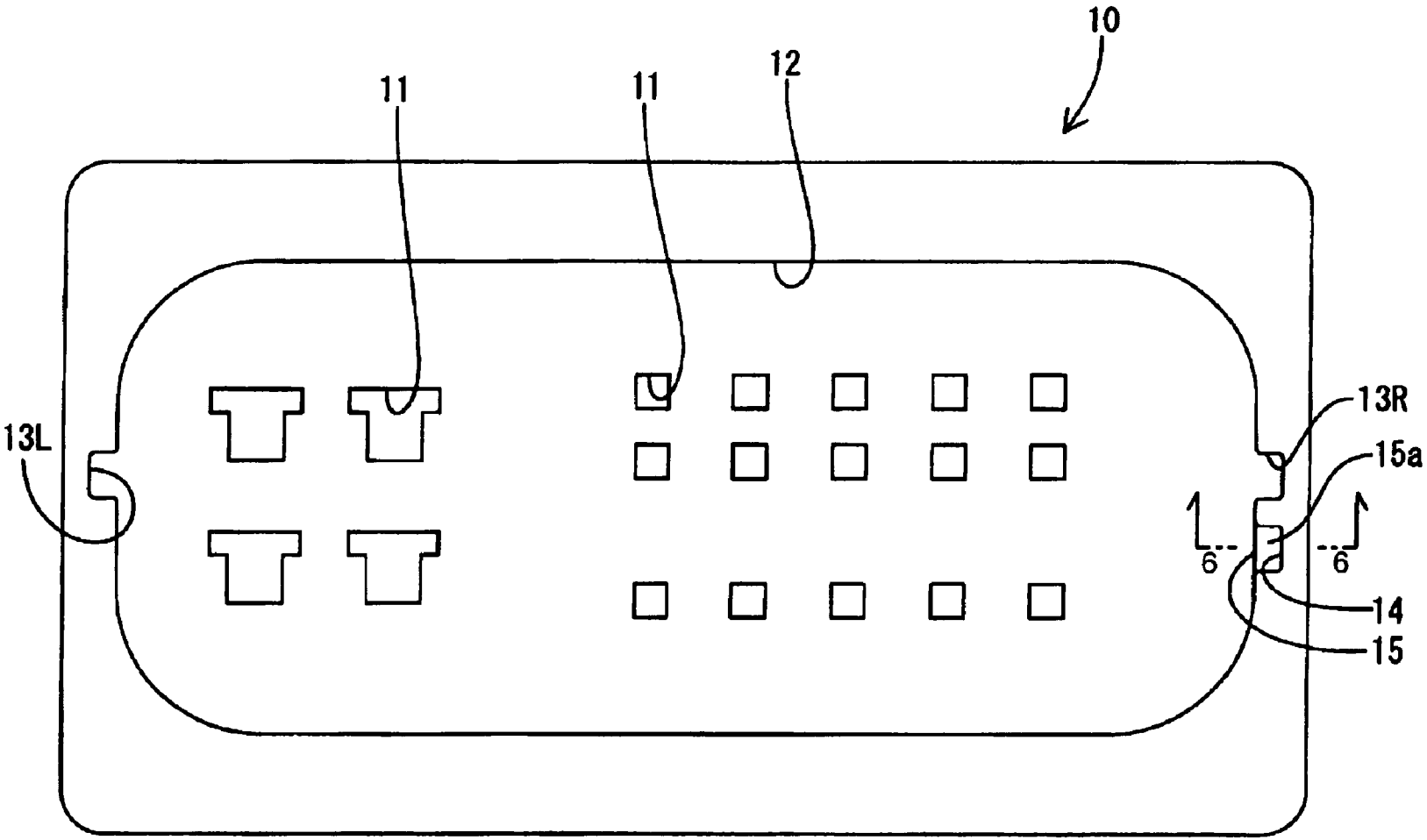
FIG. 1 is a front-elevational view of a female housing of a first embodiment.
Figure 2:
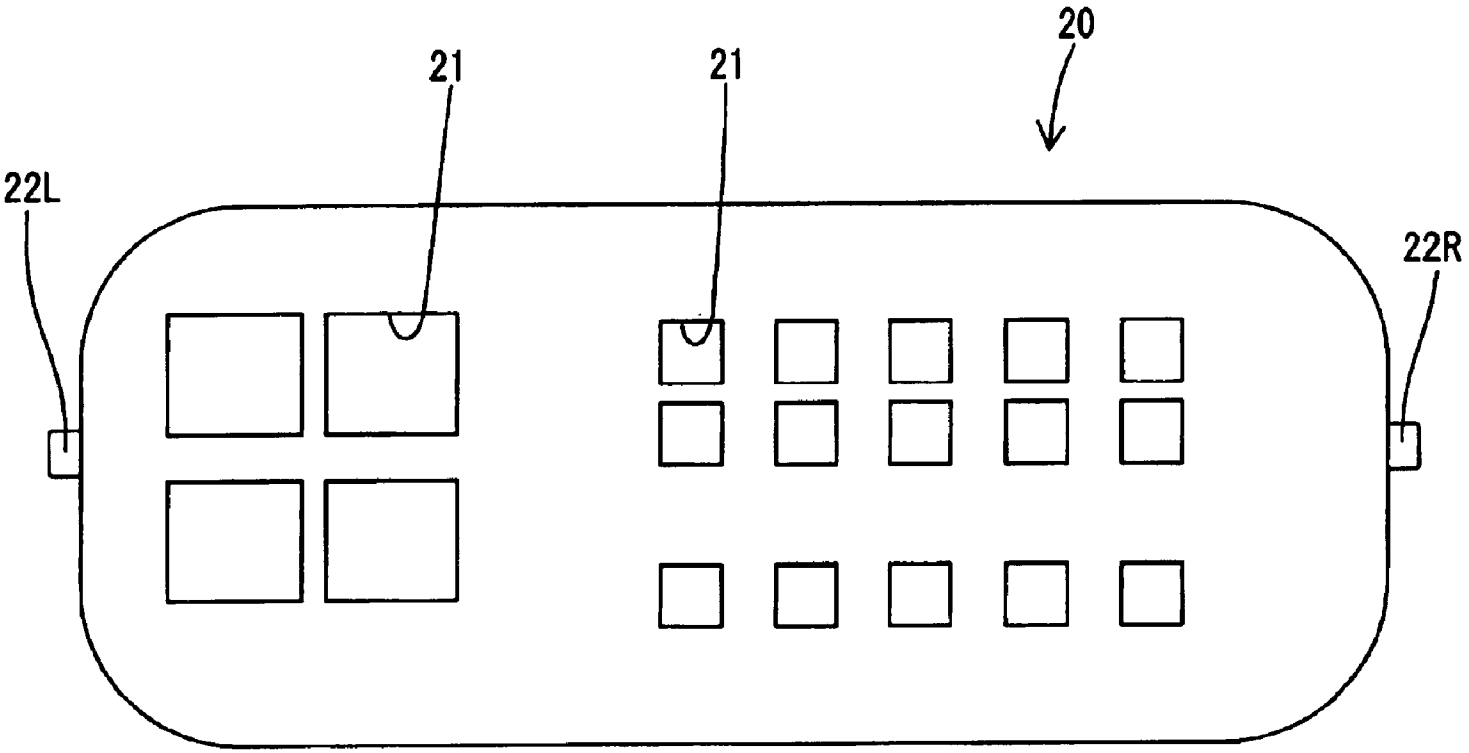
FIG. 2 is a rear view of a male housing.

A connector comprises is illustrated in FIGS. 1 to 7, and includes a female housing 10 and a male housing 20 that can be properly fitted together. A wrong male housing 30 is located in the vicinity of the male housing 20. The wrong housing 30 is identical in size and shape the outer periphery to the male housing 20, but differs from the male housing 20 with respect to the number of poles. The shapes of openings of cavities 11 in the female housing 10, the shapes of openings of cavities 21 in the male housing 20 and the shapes of openings of cavities 31 in the wrong housing 30 are shown schematically in the figures.

The female housing 10 has a fitting recess 12 that is open to a front face, which is the face appearing in FIG. 1. The fitting recess 12 has a generally rectangular shape with four rounded corners as viewed from the front. Narrow elongate grooves 13L and 13R of a generally square cross-section are formed respectively in left and right inner side surfaces of the inner periphery of the fitting recess 12, and extend straight parallel to a direction of fitting of the two housings 10 and 20. The left and right grooves 13L and 13R extend from the front face at the open end of the fitting recess 12 of the female housing 10 to a position near to an inner end surface of the fitting recess 12.

An escape recess 14 is formed in the right inner side surface slightly below the groove 13R. The escape recess 14 is parallel to the direction of fitting of the two housings 10 and 20, and an inner end surface of the escape recess 14 is disposed forwardly of the inner end of the groove 13R. Thus, the inner end surface of the escape recess 14 is disposed closer to the front surface of the female housing 10 than the inner end of the groove 13R is. Accordingly, the length of the escape recess 14 in the fitting direction is smaller than the length of the groove 13R. The cross-sectional size and shape of the escape recess 14 is the same as the cross-sectional size and shape of the groove 13R.

An interference portion 15 is defined at the inner end of the escape recess 14, and a projection 32R of the wrong housing 30 is brought into abutting engagement with the interference portion 15 when the wrong housing 30 is fit into the female housing 10. An abutment surface 15*a* is formed on the interference portion 15 and defines the inner end surface of the escape recess 14. The abutment surface 15*a* is oblique relative to the direction of fitting of the two housings 10 and 30, and is inclined in so that the inner peripheral surface of the fitting recess 12 and the outer peripheral surface of the wrong housing 30 move toward each other when a fitting force acts on the abutment surface 15*a*.

The male housing 20 can be fit into the fitting recess 12, and is prevented from moving (shaking) relative to the fitting recess 12 in a direction perpendicular to the fitting direction both during the fitting process and in a completely fitted condition. Projections 22L and 22R are formed respectively on left and right side surfaces of the outer periphery of the male housing 20 and correspond respectively to the left and right grooves 13L and 13R in the fitting recess 12. The projections 22L and 22R are dimensioned and configured to slide smoothly in contact with the inner surface of the corresponding groove 13L, 13R without shaking relative thereto and without producing a large friction during the fitting of the two housings 10 and 20.

Projections 32L and 32R are formed respectively on left and right side surfaces of the outer periphery of the wrong housing 30. The left projection 32L of the wrong housing 30 is identical in shape, dimensions and position to the left projection 22L of the male housing 20. However, the right projection 32R of the wrong housing 30 is below the right projection 22R of the male housing 20 (i.e., at a position deviated from the projection 22R in the direction of the periphery), and is at a position corresponding to the escape recess 14 and the interference portion 15 in the fitting recess 12. A distal end surface (lower surface in FIG. 7) of the right projection 32R of the wrong housing 30 is recessed rearwardly (upwardly in FIG. 7) from a front face of the wrong housing 30 in the fitting direction. An abutment surface 32Ra is defined at the distal end of the right projection 32R serves and is inclined in the same direction and at the same angle as the abutment surface 15*a* of the interference portion 15.

Figure 3:
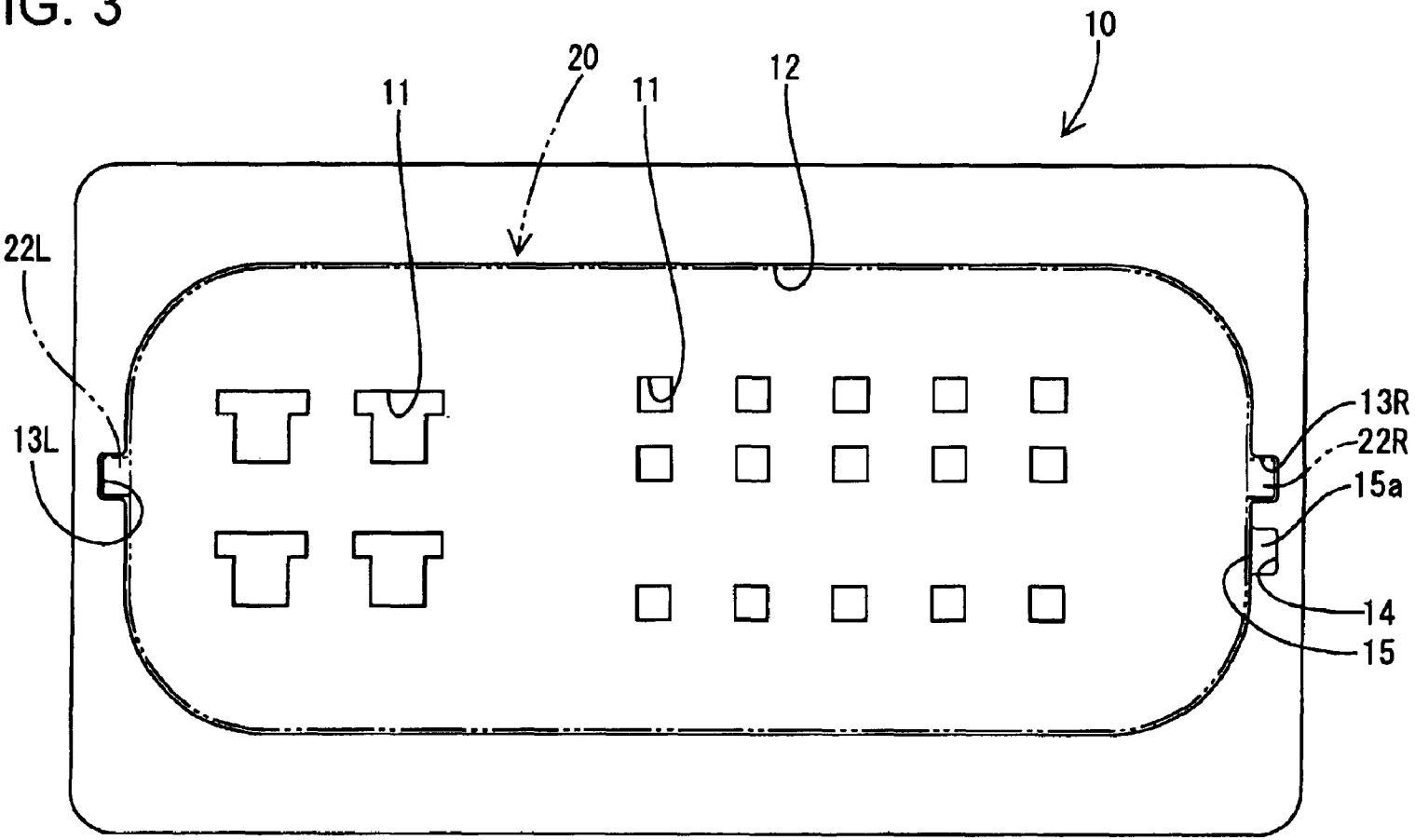
FIG. 3 is a front-elevational view showing a condition in which the proper-combination male housing is fitted in the female housing.
Figure 4:
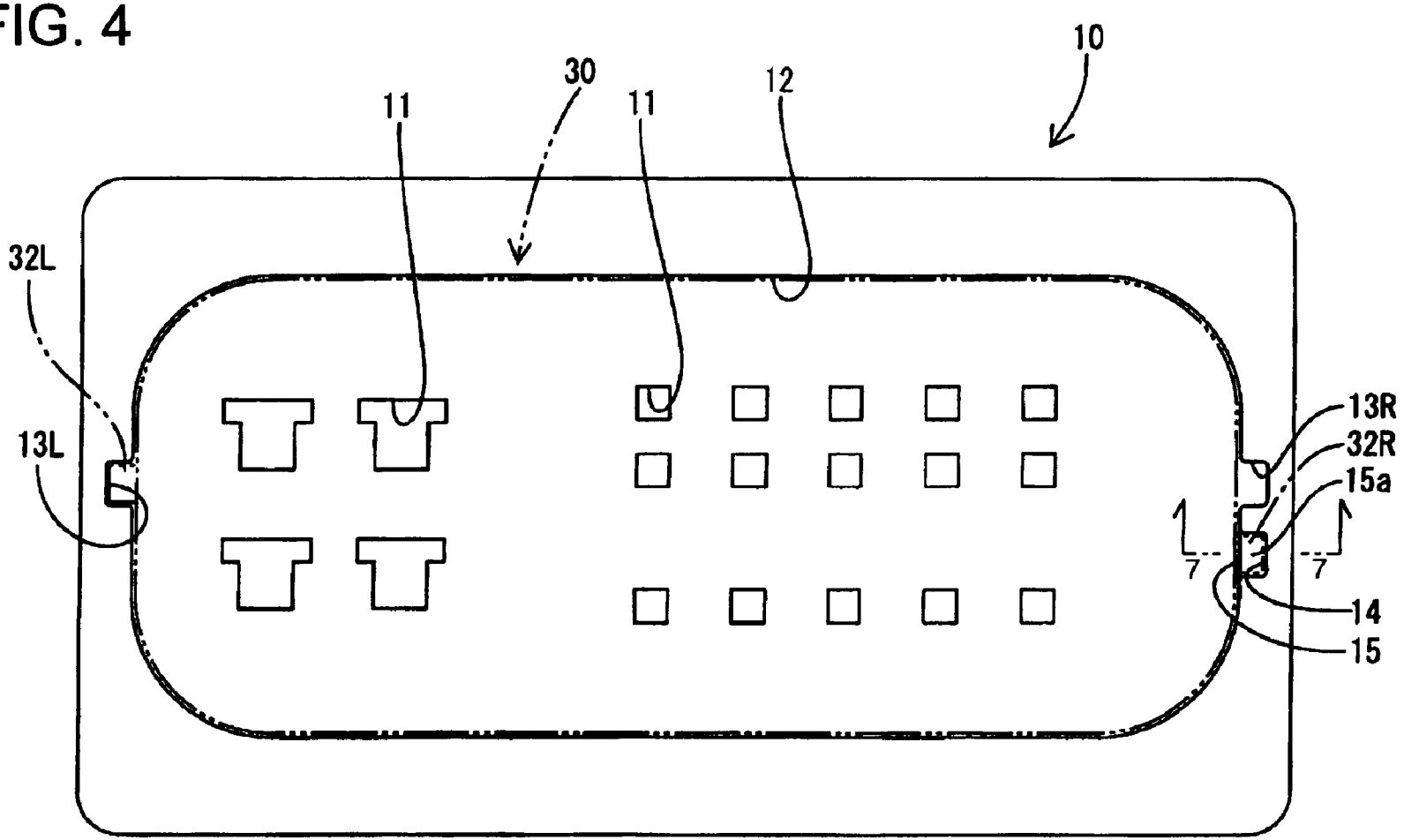
FIG. 4 is a front-elevational view showing a condition in which an improper-combination male housing is fitted in the female housing.
Figure 5:
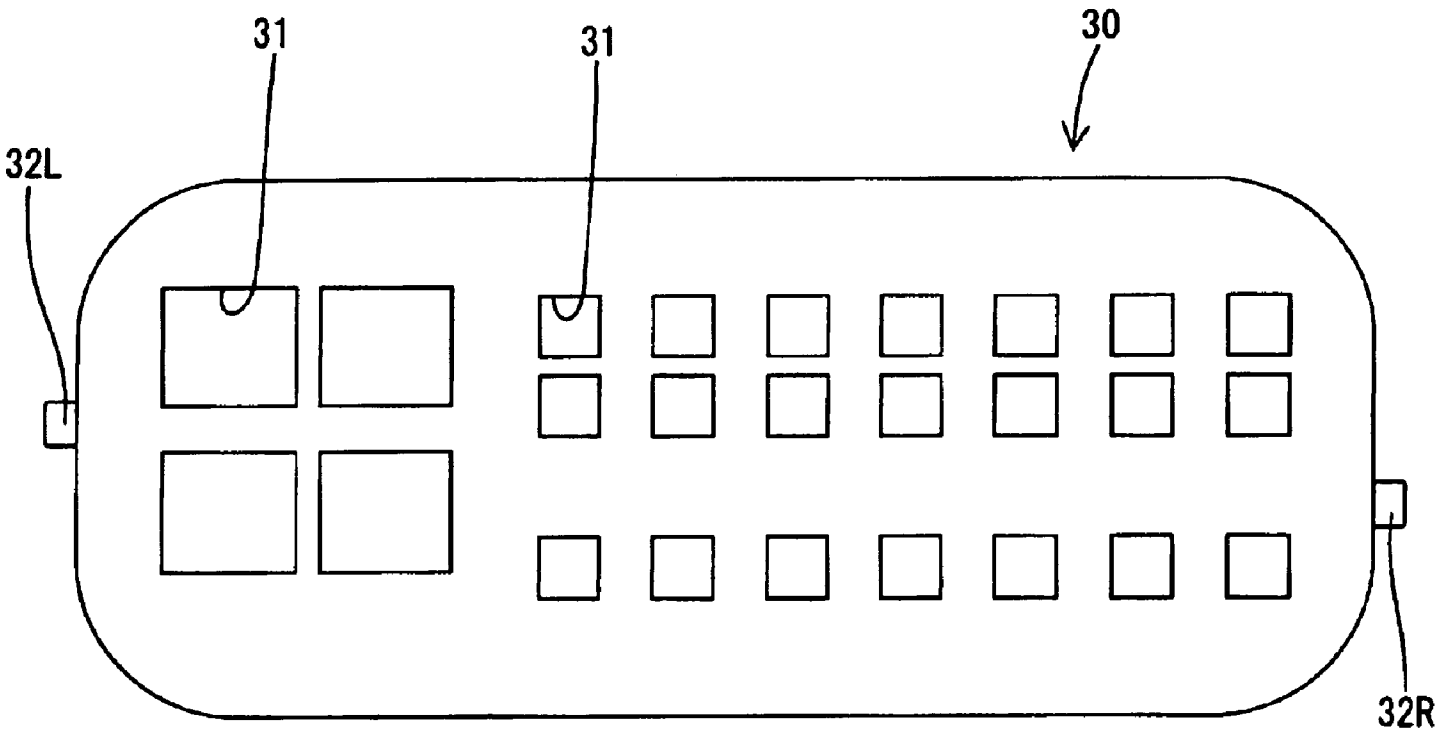
FIG. 5 a rear view of the improper-combination male housing.
Figure 6:
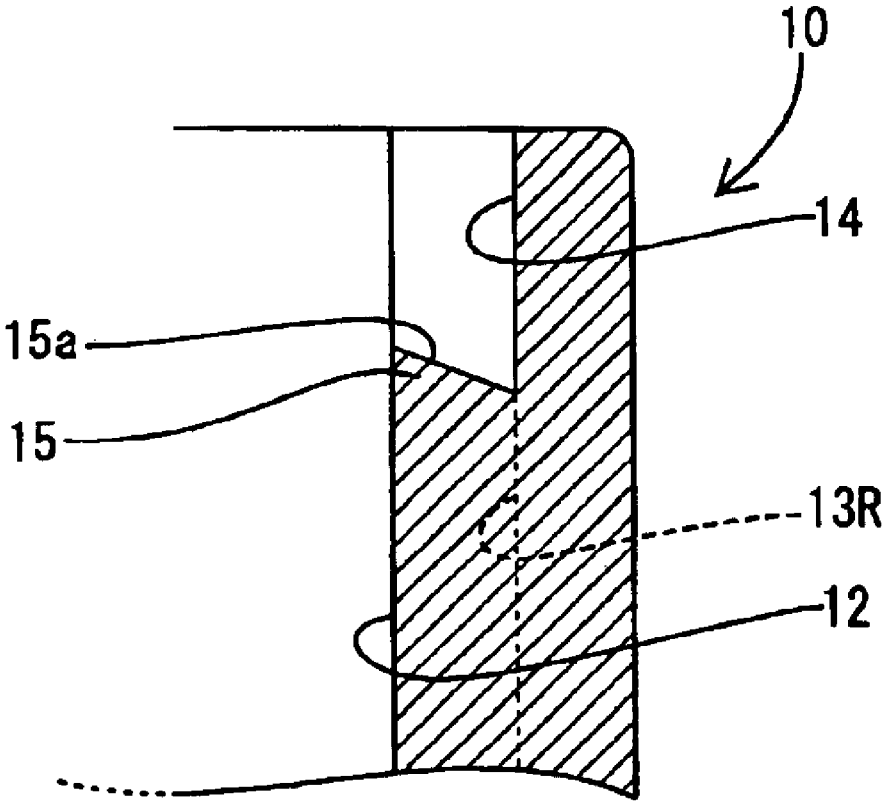
FIG. 6 is an enlarged cross-sectional view taken along the line 6—6 of FIG. 1.

The male housing 20 can be fit into the female housing 10 to form a proper combination. More particularly, the left and right projections 22L and 22R of the male housing 20 fit respectively in the corresponding left and right grooves 13L and 13R of the fitting recess 12 as shown in FIG. 3, so that the two housings 10 and 20 fit properly together completely and without hindrance.

Figure 7:
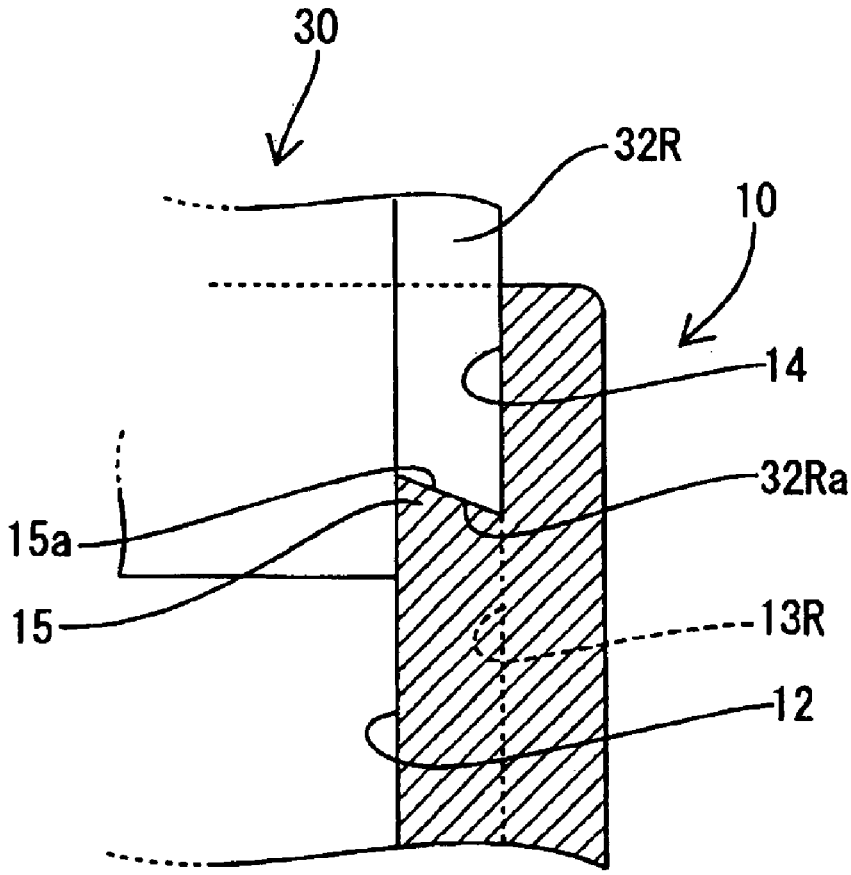
FIG. 7 is an enlarged cross-sectional view taken along the line 7—7 of FIG. 4.

On the other hand, the wrong housing 30 has a different number of poles than the male housing 20 and should not be fit into the female housing 10. However, an attempt may be made by mistake to insert the wrong housing 30 into the female housing 10. In this situation, the left projection 32L of the wrong housing 30 enters the left groove 13L of the fitting recess 12 while the right projection 32R of the wrong housing 30 enters the escape recess 14 of the fitting recess 12. Thus, part of the wrong housing 30 is fit into the fitting recess 12. However, a small movement of the wrong housing 30 into the fitting recess 12 brings the abutment surface 32Ra at the distal end of the projection 32R into abutting engagement with the abutment surface of the interference portion 15, as shown in FIG. 7, and brings the abutment surface 32PA into abutting engagement with the abutment surface 15*a*. Thus, the wrong housing 30 is prevented from being fit further, and the wrong housing 30 cannot be fit deep into the proper fitting position. Therefore, the attempt to fit the wrong housing 30 into the female housing 10 is positively detected.

The abutment surfaces 32Ra of the projection 32R and the abutment surface 15*a* of the interference portion 15 both are inclined relative to the fitting direction. This inclination draws the right inner side surface of the fitting recess 12 towards the right outer side surface of the wrong housing 30 when the wrong housing 30 is urged forcibly into the fitting recess 12. Therefore, the fitting recess 12 will not be deformed away from the outer surface of the wrong housing 30, and hence the abutment surfaces 15*a* and 32Ra will not be brought out of engagement with each other. Accordingly, the abutting surfaces 15*a* and 32Ra are positively kept in an engaged condition, so that the fitting of the two housings 10 and 30 relative to each other prevented from proceeding farther.

As described above, an attempt may be made to fit the housings 10 and 30 together to form an improper combination. However, such an attempt brings the projection 32R into abutting engagement with the interference portion 15, and the inner peripheral surface of the fitting recess 12 is moved toward the outer peripheral surface of the male housing 20 due the inclination of the two abutment surfaces 15*a* and 32Ra. Therefore, the fitting recess 12 cannot be deformed to spread outwardly and the fitting of the wrong housing 30 cannot proceed.

The projection of the wrong housing and the interference portion of the fitting recess could be formed respectively at the front faces of the wrong housing 30 and female housing 10. In this situation, the projection would be brought into abutting engagement with the interference portion before the fitting is started. Accordingly, the operator could fail to become aware of an improper combination or an improper disposition, and could mistakenly assume that the two housings are merely out of alignment with each other. Hence, the operator could try to continue the fitting operation.

In this embodiment, however, the interference portion 15 is at the inner end of the escape recess 14 in the inner periphery of the fitting recess 12, and the abutment surface 32Ra of the projection 32R is recessed rearwardly from the front face of the wrong housing 30. Therefore the fitting operation is limited after a predetermined stroke of the wrong housing 30, and the improper combination or the improper disposition can be positively detected.

The invention is not limited to the above embodiment described above with reference to the drawings, and for example, the following embodiments fall within the technical scope of the invention, and other modifications than the following can also be made without departing from the subject matter of the invention.

In the above embodiment, the plurality of kinds of male housings and the plurality of kinds of female housings are prepared, and when the female and male housings form an improper combination, the projection is brought into abutting engagement with the interference portion. However, the invention can be applied to the type of connector in which one kind of male housing and one kind of female housing are fit together, and when the male housing is turned or inverted about its axis (extending in the fitting direction) to be improperly disposed relative to the female housing, a projection can abut against an interference portion, thereby detecting such erroneous fitting.

In the above embodiment, although two kinds of male housings and two kinds of female housings are prepared. However, the invention can be applied to more than two kinds of male housings and more than two kinds of female housings are prepared.

In the above embodiment, the projections are on the male housing while the grooves and the interference portion are on the female housing. However, the projections may be on the inner periphery of the fitting recess of the female housing while the grooves and the interference portion may be on the outer periphery of the male housing.

In the above embodiment, the interference portion is provided at only one region. However, interference portions may be provided at a plurality of regions.

In the above embodiment, the interference portion is recessed, and the projection is recessed rearwardly from the front face of the housing. However, one or both of the interference portion and the projection may be flush with the front faces of the housings.

What is claimed is:

1. A connector comprising a female housing having a fitting recess, and a male housing for fitting into said fitting recess; wherein a projection is formed on one of an outer periphery of said male housing and an inner periphery of said fitting recess, and a groove is formed in the other; and when said female and male housings form a proper combination, or are properly disposed relative to each other, said projection is fit into said groove, thereby allowing said two housing to be fit together; and when said female and male housings form an improper combination, or are improperly disposed relative to each other, said projection interferes with the mating housing to limit the fitting of said two housings; characterized in that:

an interference portion is formed at said housing having said groove, and when said two housings form an improper combination, or are improperly disposed relative to each other, said projection abuts against said interference portion; and an abutment surface of said interference portion and an abutment surface of said projection are oblique relative to a direction of fitting of said two housings, and are inclined in such a direction that when a fitting force acts on said abutment surfaces, the inner periphery of said fitting recess and the outer periphery of said male housing are moved towards each other.

2. The connector of claim 1, characterized in that an escape recess for receiving said projection is formed in the inner periphery of said fitting recess or the outer periphery of said male housing, and said interference portion being formed at an inner end of said escape recess, and when said male housing is fit a predetermined amount into said fitting recess, said abutment surfaces abut against each other.

3. The connector of claim 1, characterized in that said abutment surface of said projection is recessed rearwardly from a front face of said housing having said projection, and when said male housing is fitted in a predetermined amount into said fitting recess, said abutment surfaces abut against each other.

4. A connector system, comprising:

a first male housing having an outer periphery with a specified shape and at least one guide at a specified position on the outer periphery;

a second male housing having an outer periphery with a shape substantially identical to the specified shape of the outer periphery of the first housing and having at least one guide on the outer periphery in a position different from the specified position for the guide on the first male housing; and a female housing having a fitting recess configured for at least partly receiving either of the first and second male housings, the fitting recess including at least one guide configured and disposed for slidably receiving the guide of the first male housing so that the first male housing and the female housing can be fit completely together, the fitting recess further having at least one guide with an interference portion for engaging the guide of the second male housing and permitting only partial fitting of the second male housing into the fitting recess and preventing complete fitting of the second male housing into the fitting recess.

5. The connector system of claim 4, wherein the interference portion has an abutment surface, and the guide of the second male housing has an abutment surface, the abutment surfaces being aligned oblique to a direction of fitting of said two housings, and being inclined in such a direction that when a fitting force acts on said abutment surfaces, an inner periphery of said fitting recess and the outer periphery of said second male housing are moved towards each other.

6. The connector of claim 4, wherein said abutment surface of said projection is recessed rearwardly from a front face of said second male housing so that when said male housing is fit a predetermined amount into said fitting recess, said abutment surfaces abut against each other.

7. The connector of claim 4, wherein the guides of the first and second male housings are projections, and the guides of the female housing are grooves.

* * * * *